US012241347B2

(12) United States Patent
Murski

(10) Patent No.: US 12,241,347 B2
(45) **Date of Patent: *Mar. 4, 2025**

(54) ROBUST GAS LIFT VALVE SUITABLE FOR USE IN HARSH ENVIRONMENTS WITH MULTIPLE SEALS

(71) Applicant: Liberty Lift Solutions LLC, Houston, TX (US)

(72) Inventor: Daniel Ryan Murski, Victoria, TX (US)

(73) Assignee: Liberty Lift Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/827,299

(22) Filed: Sep. 6, 2024

(65) Prior Publication Data

US 2024/0426197 A1 Dec. 26, 2024

Related U.S. Application Data

(63) Continuation of application No. 18/352,098, filed on Jul. 13, 2023.

(60) Provisional application No. 63/483,988, filed on Feb. 9, 2023.

(51) Int. Cl.
*E21B 43/12* (2006.01)

(52) U.S. Cl.
CPC ..... *E21B 43/123* (2013.01); *Y10T 137/2934* (2015.04)

(58) Field of Classification Search
CPC ..... Y10T 137/2934; E21B 43/123
See application file for complete search history.

(56) References Cited

U.S. PATENT DOCUMENTS 2,761,465 A * 9/1956 Garrett ..... E21B 43/123 137/155
3,223,109 A * 12/1965 Cumming ..... E21B 43/122 417/115
4,067,350 A * 1/1978 Raggio ..... E21B 43/123 137/155
4,422,506 A 12/1983 Bech
(Continued)

FOREIGN PATENT DOCUMENTS

CN 201196062 2/2009

OTHER PUBLICATIONS

Zlatko Salihbegovic, Gas lift valve bellow crimping and protection from high dome and injection pressure, ALDC Gas Lift Workshop, Jun. 20-23, 2022, Houston, Texas, pp. 1-20, see particularity pp. 10-11.

(Continued)

*Primary Examiner* — Hailey K. Do

(57) ABSTRACT

A gas lift valve including a body with interior charging chamber; a housing defining a bore in fluid communication with the charging chamber; a plug positioned within the bore and an a first O-ring forming a seal between an external surface of the plug and an interior surface of the bore, a crush washer is positioned between the plug and a surface of the housing; and a cap positioned with respect to the housing such that the plug is positioned within the cap interior bore and a second O-ring forms a seal between a first external surface of the housing and a first interior surface of the cap.

19 Claims, 3 Drawing Sheets

(56) References Cited

U.S. PATENT DOCUMENTS

| | | | | |
|---|---|---|---|---|
| 4,625,941 | A * | 12/1986 | Johnson | E21B 43/123 417/112 |
| 5,170,815 | A * | 12/1992 | Going, III | E21B 17/20 137/155 |
| 7,370,706 | B2 | 5/2008 | Becker et al. | |
| 11,242,732 | B2 | 2/2022 | Salihbegovic | |
| 11,661,827 | B2 | 5/2023 | Burkart et al. | |
| 11,686,185 | B2 | 6/2023 | Salihbegovic | |
| 2014/0069659 | A1 | 3/2014 | Wang et al. | |
| 2014/0219842 | A1 | 8/2014 | Casella | |
| 2015/0191984 | A1 | 7/2015 | Albert | |
| 2021/0054725 | A1 | 2/2021 | Salihbegovic | |
| 2021/0086248 | A1 | 3/2021 | Salihbegovic | |

OTHER PUBLICATIONS

PCT/US24/15161, International Search Report and Written Opinion of the International Searching Authority, Date of Mailing Jun. 10, 2024.
Google Patents English Translation CN20119606.
Schlumberger, Nova Gas Lift Valves, 2015.
Weatherford, Ultra-HP Wireline-Retrievable Injection-Pressure-Operated Gas-Lift Valve, 2016.

* cited by examiner

ROBUST GAS LIFT VALVE SUITABLE FOR USE IN HARSH ENVIRONMENTS WITH MULTIPLE SEALS

CROSS REFERENCE TO RELATED APPLICATIONS

This application claims priority to U.S. Provisional Patent Application No. 63/483,988 filed on Feb. 9, 2023 and entitled "Robust Gas Lift Value Suitable for Use in Harsh Environments" to U.S. patent application Ser. No. 18/352,098, filed Jul. 13, 2023 and entitled "Robust Gas Lift Value Suitable for Use in Harsh Environments" the entire contents of which are incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

The present disclosure relates to gas lift valves for use in artificial gas lift applications. In certain such applications, pressurized gas is used to form or supplement gas within production fluids to promote the production of, for example, oil and gas from a well.

In many artificial gas lift applications one or more gas lift valves are used to control the injection of gas into reservoir fluids. In such applications, pressurized gas is applied to the input of the one or more gas lift valves and each gas lift valve can be set to open when the pressure of the applied gas reaches a certain set pressure, sometimes referred to as a charge pressure. This charge pressure also correlates to a relative closing pressure of the valve.

In many of such applications, the pressure setting at which a given gas lift valve will open is set by the injection of a gas (typically nitrogen) through a valve element (typically a dill or Schrader-type valve) into a cavity within the gas lift valve (often referred to as a dome). In operation, the pressurized gas within the cavity or chamber acts against a biasing member within the valve, typically in the form of a bellow, that, in turn, acts against a movable valve element. In such applications, when the pressure within the reservoir meets or exceeds the set point pressure for a given valve, the valve will be forced open and a gas applied at the input of the valve will be injected into the reservoir fluids.

A long standing problem in the field of artificial gas lift is that conventional gas lift valves often do not operate properly (or over a desired length of time) in certain environments and/or that such gas lift valves are subject to damage if uncommon well conditions are encountered.

For example, in applications where a gas lift valve is used in a high temperature environment, it is not uncommon for one or more of the internal gasketing materials maintaining the gas pressure within the dome in the valve to either degrade, expand, or adjust to the point that a seal maintaining the pressure containment within the dome fails in part or in total. When such an event occurs, some or all of the pressurized gas within the dome will exit the gas lift valve, resulting in either complete failure of the gas lift valve or sub-optimum performance of the valve as a result of the undesired change in the internal charge pressure in the valve.

A further long standing problem in the field of artificial gas lift valves is that conventional valves are prone to failure in the event that the reservoir in which the valve is operating is subjected to an unanticipated spike in pressure. Such an unexpected pressure spike can occur, for example, when a well adject to a producing well in which a gas lift valve is positioned, is undergoing a hydraulic fracturing operation. In such applications, very high-pressure fluids are injected into the well undergoing the hydraulic fracturing operation with the goal of creating or expanding fractures within the rock surfaces or other formations adjacent the treated well. In such operations, it is possible that a fracture will be created that can extend from the treated reservoir to the producing reservoirs in which the gas lift valve is positioned which can result in a significant spike in the reservoir pressure of the producing well. It is known that such an undesired pressure spike (or "frac hit") can damage conventional gas lift valves, either rendering the valve—and typically more than one gas lift valves within the producing well—inoperable, or causing an adjustment in the pressure setting of the valve (or multiple valves) resulting in non-optimal valve operations.

One object of the embodiments discussed herein is to reduce or overcome the above-identified and other problems associated with conventional gas lift valve constructions.

It is to be understood that the discussion above is provided for illustrative purposes only and is not intended to and does not limit the scope or subject matter of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief summary of the inventions indicating their nature and substance may be understood from the subject matter presented in the claims filed with this application, which are incorporated into this brief summary by reference for all purposes, and by the inventions presented in any claims that may be issued from this application, which claims also are incorporated into this brief summary by reference for all purposes.

None of these brief summaries of the inventions is intended to limit or otherwise affect the scope of what has been disclosed and enabled or the appended claims, and nothing stated in this Brief Summary of the Invention is intended as a definition of a claim term or phrase or as a disavowal or disclaimer of claim scope.

BRIEF DESCRIPTION OF THE DRA WINGS

The following figures form part of the disclosure of inventions and are included to demonstrate further certain aspects of the inventions. The inventions may be better understood by reference to one or more of these figures in combination with the detailed description of certain embodiments presented herein.

Figure 1:
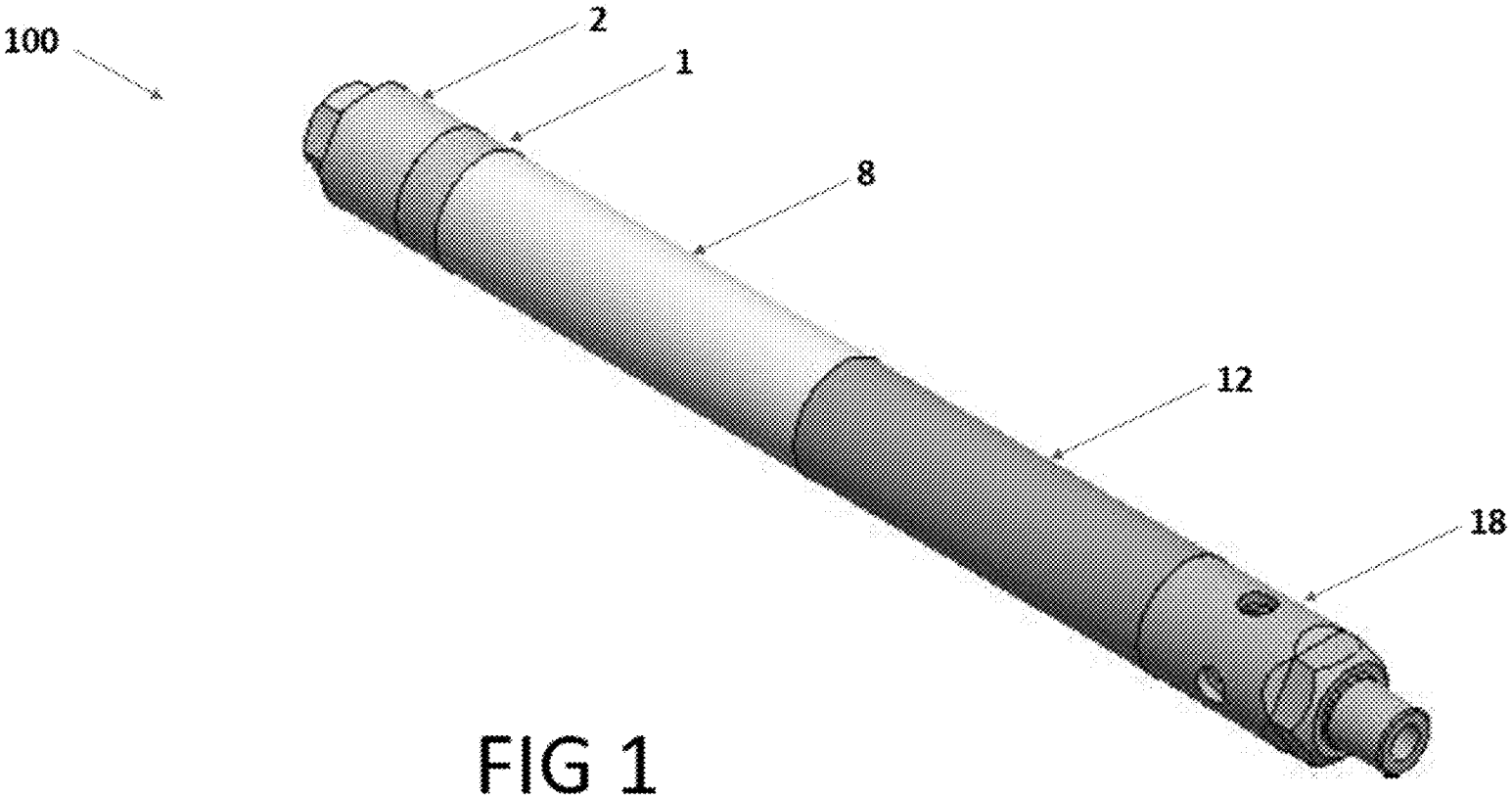
FIG. 1 illustrates an exemplary embodiment of a robust gas lift valve 100 constructed in accordance with certain teachings of this disclosure that is suitable for use in harsh environments.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of the inventions disclosed or the scope of the appended claims. Rather, the Figures and written description are provided to teach a person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Reference throughout this disclosure to "one embodiment," "an embodiment," or similar language means that a particular feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each Figure may refer to elements of proceeding Figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Turning now to several descriptions, with reference to figures, or particular embodiments incorporating one or more aspects of the disclosed inventions, FIG. 1 illustrates an exemplary embodiment of a robust gas lift valve 100 constructed in accordance with certain teachings of this disclosure that is suitable for use in harsh environments. Such harsh environments include, but are not limited to, downhole environments where the gas lift valve will be subject to high temperatures; environments (downhole or otherwise) where the gas lift valve may be subject to impacts and/or vibrations after it is set; environments where the gas lift valve may be subjected to potentially harmful chemicals and/or well bore fluids, gases, and foreign wellbore materials from a reservoir, and/or environments where there is a possibility of malicious adjustment of a set gas lift valve before it is positioned downhole.

In the illustrated embodiment of FIG. 1, the main externally visible body of the gas lift valve 100 gas lift valve includes, from right to left in the figure a valve seat housing 18, a bellow housing 12, a dome housing 8, and a valve core housing 1.

Although not illustrated in FIG. 1, in different implementations additional housings or mechanisms may be coupled to the gas lift valve 100 prior to its installation for use downhole. For example, in some embodiments a check valve assembly and/or a latching assembly may be coupled (via threads or otherwise) to the distal end of the valve seat housing 18.

The described housing elements may be formed from any material suitable for use in the intended or potential operation environments in which the valve 100 may be used. Such materials include, but are not limited to 316 stainless steel, other grades of stainless steel, various metal alloys including MONEL® metal alloys, heat, or chemical steel such as steel treated with a nitriding process; or any other suitable material. In some embodiments, each of the housings will be formed from the same material. In other embodiments, the housing components may each be formed from different materials and/or only some of the housing elements may be formed from the same material. The various housing elements may be formed through a machining process, a casting process, a 3D printing process, combinations of the foregoing, or any other suitable construction process or combination of processes.

In the embodiment of FIG. 1 each of the housing elements is coupled to an adjacent element via a threaded connection, although alternative connection methods could be used without departing from the teachings of this disclosure. Such alternate connection methods include friction welding, press fitting, brazing, soldering, gas-tight quick connect connection and other suitable types of connections.

In the embodiment of FIG. 1. The dome housing 8 is depicted as a component separate from the valve core housing 1 and the dome housing 8 and the valve core housing 1 are shown as being connected via a threaded connection. This is only one example of a valve constructed according to the teachings of this disclosure. Alternative embodiments are envisioned, wherein other coupling methods are used (as discussed above). Still further alternative embodiments are envisioned wherein the valve housing 1 and the dome housing 8 are formed as a single, integral component.

Figure 2:
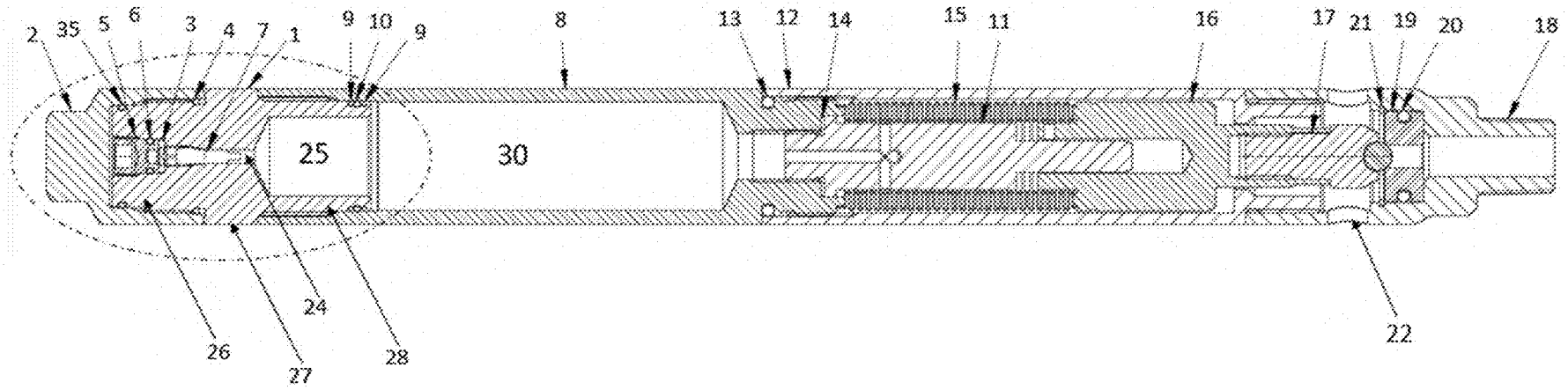
FIG. 2 illustrates additional details of the exemplary gas lift valve 100 and which depicts the exemplary valve 100 of FIG. 1 in cross section.

Additional details of the exemplary gas lift valve 100 are reflected in FIG. 2, which depicts the exemplary valve 100 in cross section.

As reflected in FIG. 2, the valve seat housing 18 defines a plurality of openings 22 (only one of which is through which injection gas may pass).

As also shown, in the figure a valve seat 19 is positioned within a recess formed in the seat housing 18, and a resilient sealing element in the form of an O-ring 20 is positioned within a grove formed in the seat housing to form seal between valve seat 19/O-ring 20 assembly and the seat housing 18. The O-ring 20 may be formed of any suitable material, including elastomeric materials such as VITON® 90D synthetic rubber, a FFKM base material such as CHEMRAZ® elastomer, a harsh environment material such as KALREZ® synthetic rubber, or any other suitable O-Ring material. In some embodiments, the elastomeric material may be selected to have a high temperature rating for example, in some embodiments, a temperature rating of 350° Fahrenheit or greater. It will be appreciated that the material used to form the O-Ring 20 may be used to form any of the O-Rings or other resilient structures disclosed herein.

A retaining clip 21 may be used to help retain the valve seat 19/O-ring 20 assembly within the valve seat 19. The retaining clip 21 may be constructed of brass, stainless steel, alloy steel, INCONEL® nickel alloy, or any other suitable material.

As shown in FIG. 2, the valve seat 19 includes an interior bore that, when not blocked, creates a path for fluid (e.g., injection gas) to flow from the outside of the gas lift valve 100, through the openings 22 in the valve seat housing 18, through the bore in the valve seat, and out of a discharge port of the valve or through the discharge port of the gas lift valve 100 into an affixed check valve or other additional affixed feature. Any such additional affixed features may be attached to the valve 100 using threads, a latching mechanism, O-Ring sealing fixture, or any other suitable method of attachment.

In the exemplary valve 100 of FIG. 2, a movable bellow assembly is positioned in the interior of the bellow housing 12 that includes a guide rod 11, a bellow 15 positioned about the guide rod 11, and a ball stem assembly 17. In the example of FIG. 2, the ball stem assembly 17 includes a stem and a valve ball positioned within the stem. It will be appreciated that in alternate embodiments, the valve stem assembly 17 could be formed as an integral component including a stem portion and a valve sealing portion.

In the example of FIG. 2, a bellow adapter 16 is positioned between the bellow 15 and the ball stem assembly 17. The bellow adapter 16 may be coupled to the bellow 15 at a first end of the bellow adapter 16 (the left end in FIG. 2) end and to the ball stem assembly 17 a second end of the bellow adapter 16 (the right end in FIG. 2) through any suitable process. Such connecting processes can include brazing, welding, or any other suitable process.

The end of the bellow 15 not coupled to the bellow adapter 16 may be coupled to a projecting surface of the guide rod 11, as further shown in FIG. 2.

In the example of FIG. 2, the construction of the dome housing 8 is such that a surface of the dome housing 8 generally abuts a surface of the guide rod 11. A washer element 14, which may take the form of a crush washer, may be positioned between the guide rod 11 and the generally abutting surface of the dome housing 8. In embodiments where the washer element 14 takes the form of a crush washer, the crush washer may be formed from copper, stainless steel, or any other suitable material. It will be appreciated that such materials can be used to form any or all crush washers disclosed herein.

In the example, of FIG. 2, the bellow adapter includes a recess in which a projecting portion of the guide rod 11 is positioned. It will be appreciated that, because of this arrangement, the bellow adapter 16 (and therefore the ball stem assembly 17 coupled to one end of the bellow adapter 16) can move relative to the guide rod 11 as the bellow 15 compresses and de-compresses. It will be further appreciated that as the bellow 15 compresses and/or decompresses (and moves relative to the guide rod 11) the valve ball (or sealing surface) of the valve stem assembly 17 will move into and out of engagement with the valve seat 19, thus blocking or permitting the flow of injection gas from outside the gas lift valve, through the openings 22 in the valve seat housing, and through the opening in the valve seat 19 and out of the discharge port of the valve.

In the example of FIG. 2, the bellow housing 12 is coupled at one end to an end of the dome housing 8 and an and a resilient sealing element in the form of O-ring 13 (positioned within a recess in the dome housing 8) is used to provide a seal between the two housing elements. The O-ring may be formed from the same material, or a different material, as O-Ring 20, discussed above.

For the exemplary gas lift valve 100 of FIG. 2, the end of the dome housing 8 not coupled to the bellow housing 12 is coupled to the valve core housing 1. It will be appreciated that, in embodiments, where the dome housing 8 and the valve core housing 1 are formed as an integral component, there will be no such coupling.

In the example of FIG. 2, the dome housing 8 defines a first interior bore that serves to at least partially define an interior charging chamber 30 that exists at least partially within the dome housing 8. In the example of FIG. 2, the interior charging chamber 30 is partially (although primarily in the example) defined by the first interior bore, which is bounded by interior surfaces of the dome housing 8 and partially defined by a second interior bore 25 bounded by interior surfaces of a recess in the valve core housing 1 (discussed below). Thus, in the illustrated example, the charging chamber exists partially within the dome housing and partially within the valve core housing. It will be appreciated that, in alternate embodiments the interior charging chamber 30 may be defined by interior surfaces of the valve core housing 1 or, in embodiments where the valve core housing 1 is integrally formed with the dome housing 8, by the interior of the integral component alone.

It will be appreciated that the first interior bore within the dome housing will have a first internal or interior cross sectional diameter and that the second interior bore 25 within the valve core housing will have a second internal or interior cross sectional diameter.

As reflected in FIG. 2, in the exemplary embodiment, the valve core housing 1 includes and defines, in addition to the second interior bore 25 discussed above, a third bore of a third internal or interior cross-sectional diameter or dimension, and a fourth bore 24 of a fourth internal or interior cross sectional dimension in fluid communication with each other. In the example of FIG. 2, the fourth interior bore 24 is positioned between the second and the third interior bores.

In the example, of FIG. 2 a portion of the third interior bore is threaded.

The third bore is not separately labeled in FIG. 2 but will be understood to be the bore in valve core housing 1 in which the intermediate sealing element 5 (discussed below) is positioned. As reflected in the figures, the first, second, third and fourth bores are—in the absence of any elements positioned within the bores—in fluid communication with one another.

As reflected in the figures, both the third interior bore and the fourth interior bore have, respectively, third and fourth internal or interior cross sectional diameters.

As may be noted, in FIG. 2, the first bore, second bore, third bore, and fourth bores all pass axially through the valve core housing 1. As reflected in the figure, the interior cross-sectional diameter dimension of the fourth bore 24 is smaller than the interior cross-sectional diameter dimensions of both the first bore 30 and the second bore 25, and the interior cross sectional dimension of the first bore 30 is greater than the interior cross-sectional dimension of the second bore 25. In the example of FIG. 2, the interior cross sectional diameter of the third bore is greater than the interior cross sectional diameter of the fourth bore 24, but less than the interior cross-sectional diameter of the second bore 25.

It will be appreciated that, in the example of FIG. 2 and other anticipated embodiments, the interior cross-sections of the bores corresponding to the first, second and third bores may not be exactly constant throughout the corresponding bore structures. For example, in FIG. 2 the interior cross section of the bore corresponding to the third bore varies slightly across its axial length. In such instances, the references herein to the interior cross sectional diameter should be understood to refer to the maximum interior cross sectional diameters of the corresponding bore sections.

Figure 3:
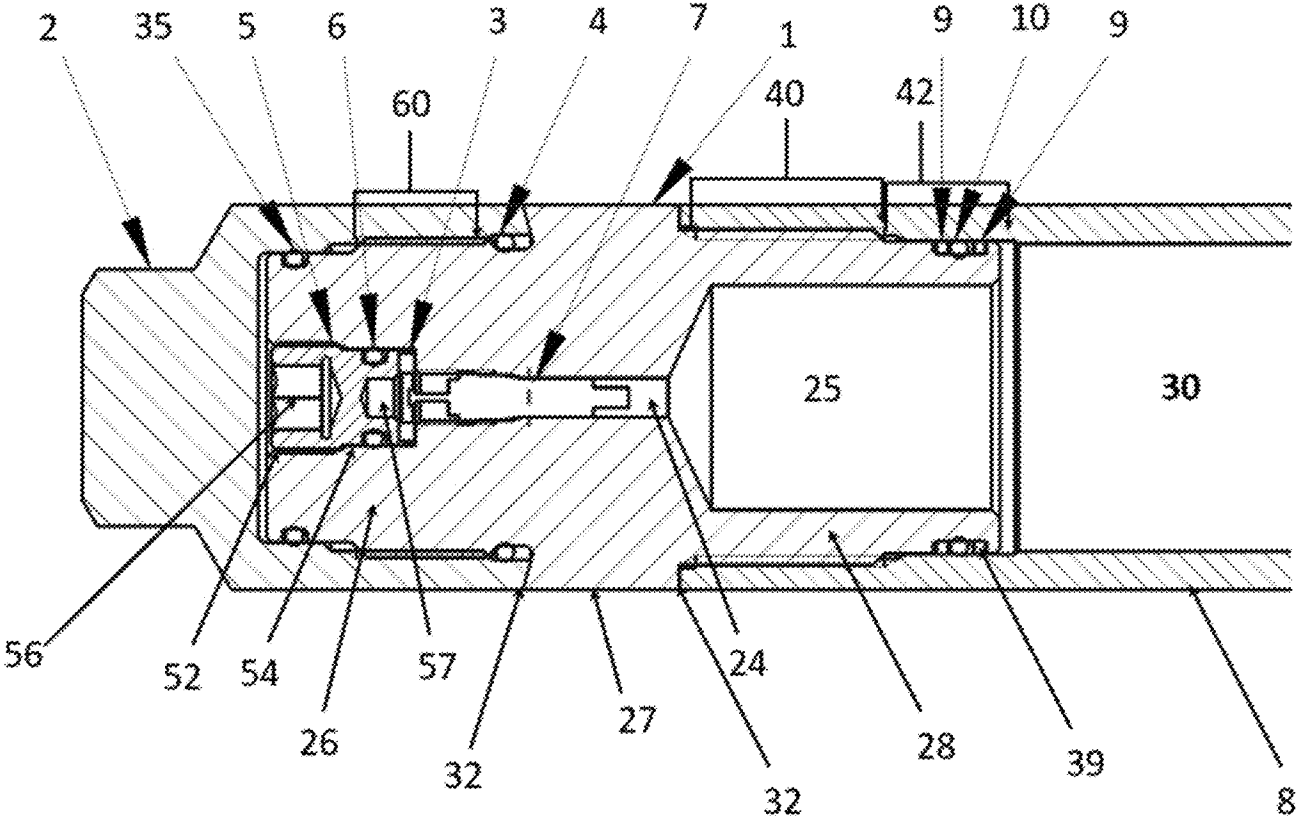
FIG. 3 illustrates further additional details of an exemplary embodiment constructed in accordance with the teachings of this disclosure and shows certain of the elements in FIG. 2 in greater detail.

In the illustrated example, a valve assembly 7 is positioned within the bore 24. The valve assembly 7 may take the form of a Schrader type valve core and, more particular, a valve core of the type that includes nitrile sealing elements, such as a nitrile valve core available from Dill Air Control Products or a sealing element comprising any other suitable material such as VITON® synthetic rubber, FFKM, KALREZ® synthetic rubber, CHEMRAZ® elastomer, or any other suitable elastomeric or sealing material. In the example of FIG. 2, the valve assembly 7 is positioned such that it is substantially completely within the fourth bore 24. Alternate embodiments are envisioned, however, wherein portions of the valve assembly 7 extend into one or both of the second bore 25 or the third bore. For example, as shown in FIG. 3, in one embodiment, the valve assembly 7 can comprise a main body and a stem wherein only the main body portion is positioned completely within the fourth bore.

In the example of FIG. 2, the valve core housing 1 includes a first exterior surface or section 27 having a first external diameter, a second exterior surface or section 26 having a second external diameter, and a third exterior surface or section 28 having a third external diameter. In the example, of FIG. 2, the second external diameter of the second exterior surface 26 is less than the first external diameter of the first exterior surface 27.

In the example of FIG. 2, at least portions of the outer surfaces of the second section 26 and the third section 28 are threaded, and the outer surface of the first exterior section 27 is substantially smooth. As depicted in FIG. 2, the outer diameter of the first section 27 is greater than the outer diameters of the second and third sections 26 and 28. In the example of FIG. 2, the outer diameter of the second section 26 is less than the outer diameter of third section 28. This is exemplary as the diameters of the second and third sections 26, 28 may be the same, or substantially the same, or the outer diameter of the third section 28 may be greater than the outer diameter of the second section 26.

In the example of FIG. 2, the interior of the third bore defines a threaded surface that may extend across all or a position of the third bore. As shown in the figure, an intermediate sealing structure 5—in the form of a partially threaded plug—is depicted as being positioned within the third interior bore. As reflected in the figure, the plug 5 includes a threaded exterior surface threadably coupled to a portion of an internally threaded section of the third bore within the valve core housing.

As further shown in FIGS. 1 and 2 in the illustrated example, the illustrated embodiment further includes a secondary sealing structure 2, in the form of a cap element. In the illustrated example, the cap element 2 defines a solid distal end (on the left of FIG. 1) and a proximal end. As shown, in the example, the cap 2 includes a recess defining a fifth interior bore having an interior surface that is at least partially threaded. In the example of FIG. 2, the cap is threadedly coupled to the second exterior surface or section 26 of the valve core housing 1 such that the proximal end of the cap abuts a lip surface extending from the valve core housing 1.

As will be appreciated from an inspection of FIG. 2, when the secondary sealing structure 2 and the intermediate sealing structure 5 are removed, depending on the open/close state of the valve assembly 7, a fluid path may be created thorough which a fluid (such as a charging gas) may pass through the valve assembly 7 into (or out of) the charging chamber 30 at least partially defined by the interior of the dome housing 8. This fluid path is beneficial, at least in that it provide a fluid path through which a charging gas (e.g., nitrogen) may be passed through the valve assembly 7 into the charge chamber 30 to build up pressure within the cavity so as to adjust and control the force required to compress the bellow 15 and open the sealing mechanism formed by the valve stem 17 and the valve seat 19. This fluid path is potentially detrimental, however, in that it provides a fluid path through which pressurized gas within the charge chamber 30 may leak from the interior of chamber 30 outside of the gas lift valve 100, thus producing an undesired change in the pressure setting at which the gas lift valve 100 would open or close should one or more of the described intended sealing mechanisms be partially compromised or fail completely.

As will be appreciated, the arrangement and combination of elements and components disclosed herein and reflected in FIGS. 1 and 2 provide a novel structure that, among other things:

(a) provides protection for the components of the system: (i) before charging, (ii) after a rough charging but before fine adjustment; (iii) and after fine adjustment;
(b) provides for efficient and effective charging; and
(c) avoids and/or minimizes the prospect of undesirable leakage after the disclosed gas lift valve is charged to the desired level.

Additional details of an exemplary embodiment constructed in accordance with the teachings of this disclosure are reflected in FIG. 3, which depicts certain of the elements in FIG. 2 in greater detail.

FIG. 3 illustrates one way the valve core housing 1 may be coupled to the dome housing 8. In FIG. 3, the valve core housing 1 is coupled to the dome housing 8 through a threaded connection and an annular seal is formed between the two elements. In the illustrated example the seal is formed through the use of a sandwich seal structure in which a resilient sealing element in the form of O-Ring 10 is sandwiched between two split rings 9, and the sandwich structure is positioned within an annular groove 39 formed in an outer surface of the valve core housing 1.

The O-Ring 10 and split rings 9 may be formed from the same material—or a different material—as the O-Ring 20 discussed above.

In the example of FIG. 3, the outer surface of the second end of the valve core housing 1 is threaded across a first axial length 40 and is substantially smooth (except for the groove 39) across a second axial length 42. It will be appreciate that this is exemplary only and that the outer surface of such end may be threaded across substantially its entire axial length. In the embodiment of FIG. 3, the interaction of the sandwich sealing assembly with the surfaces of the valve core housing 1 and the dome housing 8 form a gas-tight seal between the valve core housing 1 and the dome housing 8.

As further shown in FIG. 3, in the illustrated embodiment an end surface of the dome housing 8 mates with a surface of the valve core housing 1 to form a metal-to-metal seal across the annual region 32. In the example of FIG. 3, this seal at region 32 is formed by an abutment between relatively flat, generally perpendicular surfaces, of the valve core housing 1 and the dome housing 8. In the example of FIG. 3, It will be appreciated that this form of abutment is exemplary only and that one or both of the abutting surfaces could be angled to the same or to different degrees.

While not depicted in FIG. 3, alternate embodiments are envisioned wherein one or more elements are used to enhance the seal formed at region 32 between the valve core housing 1 and the dome housing 8. For example, embodiments are envisioned wherein a suitable engaging or gasket structure is positioned between the two housings at region. One structure that may be used is a washer of a malleable material, such as, for example, a copper crush washer 3.

In the example of FIG. 3, an exemplary intermediate sealing element 5 is positioned within the first bore of the valve core housing. In the illustrated embodiment, the intermediate sealing element is threadedly coupled to the valve core housing 1 through a threaded engagement. In FIG. 3, the threaded engagement of the intermediate sealing element 5 and the valve core housing 1 is accomplished through the engagement of an externally threaded section 52 of element 5 with an internally threaded section of the valve core housing (not labeled in FIG. 3).

In the example of FIG. 3, the sealing or plug element 5 defines an unthreaded, substantially smooth outer section 54. In the illustrated example, this unthreaded section defines an annular recess in which an O-ring 6 is positioned. As shown in the figure the unthreaded section 54 of the intermediate sealing element 5 is received within a smooth interior bore section of the valve core housing 1. Other embodiments of sealing plug 5 are envisioned in which the O-Ring 6 could be situated somewhat lower or higher on smooth outer section 54, or where additional O-Rings in addition to O-Ring 6 could be added to smooth outer section 54 to promote redundant seals.

In the exemplary embodiment multiple seals are formed between the intermediate sealing element 5 and the valve core housing 1 including a seal formed via and a resilient sealing element in the form of an O-ring 6 positioned within a groove formed in the smooth outer surface 54 of the intermediate sealing surface. The O-Ring 6 may be formed from the same material—or a different material—as the O-Ring 20 discussed above.

In FIG. 3, an additional seal is formed through the positioning of a sealing element 3, which may take the form of copper crush washer 3, between an outer annular end surface of the intermediate sealing member 5 and an annular surface of the valve core housing 1. Such a crush washer 3 will deform, and create sealing surfaces, as the intermediate sealing member 5 is screwed into the valve core housing 1 and torque is applied. As will be appreciated, the combination of the interior sealing element 5, the O-Ring 6 and the sealing element 3 form multiple seals that will tend to prevent or inhibit the flow of gas from the charging chamber 30 out of the valve 100, even if the seal(s) within the valve assembly 7 fail. As will be appreciated, the crush washer can be formed from materials other than copper.

As will also be appreciated, the combination of the intermediate sealing member 5, and the sealing element 3 form a cavity between the valve assembly 7 and the intermediate sealing member 5 where the volume of the cavity is small relative to the overall volume of the charging chamber 30. For example, in the embodiment of FIG. 3, the total volume of the cavity between the valve assembly 7 and intermediate sealing member 5 is less than 1%, and in some embodiments, less than 0.25% of the total volume of the charging chamber 30, such that any leakage through the valve assembly 7 into such cavity will result in a minimal change of the charge pressure within chamber 30 and any outward pressure source would not intrude on the intended pressure of the chamber 30 as well. In some embodiments, the volume of the cavity between the valve assembly 7 and intermediate sealing member 5 is less than or equal to 0.007% of the total volume of chamber 30.

Still further, in the illustrated embodiment a further intermediate cavity is defined by a surface of the cap 2, a surface of the valve core housing 1, a surface of the plug 5, and a surface of the resilient member 6. Such intermediate cavity is of a relatively small volume and, in the example a volume less than 2% and, in some embodiments, less than 0.25 of the volume of the charging chamber. As will be appreciated, in such embodiments failure of the sealing elements within the valve assembly 7 and/or the seal created by resilient sealing member 6 will result in a non-significant drop of the overall charging pressure, such that such failures will not materially affect the proper operation of the gas lift valve.

As reflected in FIG. 3, in the illustrated example, the dimensions of the plug 5 are such that no portion of the plug extends into the described intermediate volume.

In addition to reducing the potential for degraded or undesired performance of the disclosed gas lift valve, the disclosed structure will protect the internal valve components from undesired forces that could be created as the result of an undesired rapid change in the reservoir pressures external to the valve. For example, if a valve as described herein is subject to a "frac hit," the disclosed structures will tend to protect the components of the valve from damage.

In the embodiment of FIG. 3, the intermediate sealing element 5 defines a first axially extending cavity 56 at one end (the leftmost end in FIG. 3) and a second axially extending cavity 57 at the other end. Both cavities are optional.

In the embodiment of FIG. 3 the first cavity 56 is shaped so as to receive an end of a hex wrench to enable proper positioning of the element 5 within the valve housing 1. It will be appreciated that other approaches could be used to facilitate such positioning including the formation of alternately shaped recesses within the cavity 56 (e.g., a recess designed to receive the end of a TORX® threaded fastening device wrench) or bolt-like extension from the end of the element 5.

In the embodiment of FIG. 3 the second cavity 57 provides a clearance volume to ensure that no surface of the intermediate sealing element 5 contacts—and potentially damages or activates—the valve assembly 7. Again, this recess is optional, and the end of the element 5 closest to the valve assembly 7 can be flat or flush.

In the arrangement of FIG. 3, the secondary sealing element 2 is threadedly coupled to the first end of the valve core housing 1 via a threaded connection between an internally threaded portion 60 of the secondary sealing element 2 and an externally threaded portion of the valve core housing. In the illustrated embodiment of FIG. 3, the interior portions of the secondary sealing element 2 other than portion 60 are substantially smooth and non-threaded, as are the exterior portions of the first end of the valve core housing 1 other than the threaded portion coupled to the threaded portion of the intermediate sealing member.

In the example of FIG. 3 there are at least three seals created between secondary sealing element 2 and the valve core housing 1 which useful in protecting against unintended or undesired pressure intrusion or extrusion through the valve assembly 7.

A first seal is created by a metal-metal abutment of a surface on the secondary sealing element 2 and a surface of the valve core housing 1 at the region 32. In the example of FIG. 3, the surface of the valve core housing at which such metal-to-metal contact occurs is a lip surface formed at or by the transition between the first exterior surface 27 of the valve core housing and the second exterior surface 26. In the specifically illustrated embodiment, the abutting surfaces are angled relative to the axial axis of the gas lift valve 100, although this is exemplary only.

A second seal is created through the use of and a resilient sealing element in the form of an O-Ring 4 positioned about an exterior surface of the valve core housing 1 near the metal-metal abutment region 32. The O-Ring 4 may before from the same—or a different—material as the O-Ring 20 and may be positioned within a grove formed in the outer surface of the valve core housing 1, or—as depicted in FIG. 3—within an area bounded by a raised bump (or lip) on the outer surface of the first section of housing 1 on one side and one of the surfaces forming the metal-metal seal at region 32 on the other.

In FIG. 3, a third seal is created through the use of an and a resilient sealing element in the form of O-Ring 35 positioned within a grove formed in the outer surface of the valve core housing 1 at a point where an imaginary line passing from one point on the O-Ring 35 through the center of the O-Ring 35 to the opposite side of the O-Ring 35 will pass through the intermediate sealing member 5. The O-Ring 35 may be formed from the same material—or a different material—as the O-Rings discussed above.

More specifically, in the example of FIG. 3, each of the resilient sealing elements (or O-rings in the example) 4, 6 and 35 is in the form of a structure that defines an open central area, with the open central are being the area surrounded by the element. In the illustrated example, at least a portion of the valve assembly 7 is within the open central area of the resilient sealing element 4, and at least a portion of the plug 5 is within the open central area of the resilient sealing element 35. As will be reflected, in the illustrated example, the resilient sealing element 6 is positioned along the longitudinal axis of the illustrated gas lift valve at a position between the resilient sealing elements 35 and 4.

In the embodiment of FIG. 3 the secondary sealing element 2 is formed as a component separate from the intermediate sealing element 5. Alternate embodiments are envisioned where both elements are formed, e.g., through 3-D printing, as a single integral element.

As will be appreciate when the intermediate sealing element 5 and the secondary sealing element 2 are not coupled to the valve core housing 1, charging of the charging chamber 30 can be easily accomplished by coupling a suitable charging apparatus to the assembly and charging the charge chamber 30 through the valve assembly.

The coupling of the secondary sealing element 2 and/or the intermediate sealing element 5, individually or simultaneously to the valve core housing 1 can enhance, among other things, the protection, charging, transport, and use of the illustrated exemplary gas lift valve 100.

For example, prior to charging of the gas lift valve 100, the secondary sealing element 2 can be loosely coupled to the valve core housing 1 to protect exposed threads of the valve core housing 1 from damage and to protect the valve assembly 7 from being contaminated by dust or other potentially fouling materials. The loose coupling can thus provide protection as described above, yet permit easy removal for charging of the valve 100. In such a configuration, no intermediate protection element 5 needs to be coupled to the valve core housing 1.

In terms of pre-charge protection it will be appreciated that the same secondary sealing element 2 to be used when the gas lift valve is placed in operation (e.g., an element 2 formed of metal) need not be used for pre-charge protection. For such pre-charge protection, an alternately constructed element, such as one formed from plastic, could be used. In such implementations, the color of the protective element 2 could be used to indicate, for example, that the valve has not yet been charged and/or the pressure level to which the valve is desired to be charge.

In alternate embodiments, the valve 100—or a number of similar valves 100—can be initially roughly charged to a rough set pressure and then the secondary sealing 2 member (but not the intermediate sealing element 5) can be coupled to the valve core housing 1 during a period before such rough charged valves are finally charged through fine adjustment of the pressure within the charging chamber 30. Such use of the secondary sealing member 2 can provide a level of protection against leakage of charge gas from the valve (and protection of the threads and the valve assembly 7 against fouling) but also provides a structure that can readily be removed for fine tuning of the charge.

Still further, the disclosed valve 100 can be used in a configuration where it is charged to a desired level, the intermediate sealing element 5 is coupled to the valve core housing 1, and the secondary sealing element 2 is also coupled to the valve core housing 1. In such configurations substantial, multiple, and redundant layers of protection and protection against gas and/or fluid leakage or intrusion are provided to protect and ensure proper usage of the gas valve 100 over an extended period and in various applications and usages. Such multiple, redundant layers of production can both avoid or minimize the changes of an undesirable leak of gas from the charging chamber 30 and/or intrusion of gas and/or fluids from outside sources (e.g., wellbore gases and fluids) into the charging chamber and reduce the risk of any unwanted or malicious discharge of charge gas (since a significant number of components will need to be removed to access the valve assembly 7).

In instances, where unwanted or malicious adjustment of the pressure setting within the charging chamber is desired to be avoided, the exposed end of the intermediate sealing member 5 could be formed in a unique shape, such that only a correspondingly shaped tool can made with the exposed shape and permit removal of the intermediate sealing element 5 form the valve core assembly 1. In such an embodiment, the "key" required to remove the intermediate sealing member 5 (which would be required to adjust the pressure within the charge chamber 30) can be made available only to those individuals authorized to adjust the charge setting of the valve 100.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A gas lift valve comprising:

an assembly comprising a valve seat housing, a bellow housing, a dome housing, an end housing, a plug, and a cap, wherein the end housing is located at a first end of the gas lift valve and the valve seat housing is located at a second end of the gas lift valve;

wherein the bellow housing is coupled to the valve seat housing;

wherein the dome housing coupled to the bellow housing, and the dome housing at least partially defines an interior charging chamber;

wherein the end housing is coupled to the dome housing and the end housing defines:

a first exterior surface having a first external diameter;

a second exterior surface having a second external diameter, wherein the second external diameter is less than the first external diameter, and wherein at least a portion of the second exterior surface is threaded; and a plug receiving bore, the plug receiving bore including an internally threaded portion;

wherein the plug is at least partially positioned within the plug receiving bore and the plug includes an exterior surface threadedly coupled to a portion of the internally threaded portion of the plug receiving bore;

wherein the cap defines a cap bore having an interior surface and at least a portion of the internal surface of the cap bore is threaded, and wherein the cap is threadably coupled to the second exterior surface of the end housing; and a first resilient sealing element positioned between the interior surface of the cap bore and the second exterior surface;

a second resilient sealing element positioned between an outer surface of the plug and an interior surface of the end housing, a crush washer positioned between the plug and the end housing a third resilient sealing element positioned between an interior surface of the cap and the second exterior surface of the end housing, wherein the third resilient sealing element is located closer to the bellow housing than the first resilient sealing element; and wherein:

the second resilient sealing element is positioned along a longitudinal axis of the gas lift valve at a position between the first resilient sealing element and the crush washer; and the crush washer is positioned along the longitudinal axis of the gas lift valve at a position between the second resilient sealing element and the third resilient sealing element.

2. The gas lift valve of claim 1 wherein the end housing further defines a valve core receiving bore and a valve core is positioned within the valve core receiving bore.

3. The gas lift valve of claim 1, wherein the plug has first and second ends and the crush washer is positioned between an end of the plug and the end housing.

4. The gas lift valve of claim 1, wherein the end housing at least partially defines the interior charging chamber.

5. The gas lift valve of claim 1, wherein the dome housing is integrally formed with a valve core housing and wherein a valve core is positioned within the valve core housing.

6. The gas lift valve of claim 1, wherein the first, second, and third resilient sealing elements are O-Rings.

7. The gas lift valve of claim 1, wherein the plug includes an outer unthreaded section that defines an annular recess the second resilient member is positioned within the plug annular recess.

8. A gas lift valve comprising:

a first body portion defining at least part of a charging chamber and a valve receiving bore in fluid communication with the charging chamber, the valve receiving bore being configured to receive a valve core; and a second body portion defining a plug receiving bore in fluid communication with the valve receiving bore;

an outer exterior annular surface, the outer exterior annular surface including a threaded exterior section having a first outer diameter and a non-threaded exterior section having a second outer diameter, where the first outer diameter is less than the second outer diameter; and a plug, the plug having a maximum outer diameter that is less than the first outer diameter and the second outer diameter, the plug being at least partially positioned within the plug receiving bore; and a cap defining a bore having a first internal diameter, wherein the cap is threadedly connected to at least a portion of the threaded external section such that the plug is positioned within the bore of the cap; and a valve core positioned within the valve receiving bore; and a first O-ring positioned between a first surface of the second body portion and the cap;

a second O-ring positioned between a second surface of the second body portion and the cap; and a third O-ring positioned between the plug and second body portion.

9. The gas lift valve of claim 8, wherein no portion of the plug extends outside the plug receiving bore.

10. The gas lift valve of claim 8, first and second body portions are integral with each other.

11. The gas lift valve of claim 8 wherein the first and second O-rings are formed form an elastomeric material having a high temperature rating of 350° Fahrenheit or greater.

12. The gas lift valve of claim 8 further comprising a crush washer positioned between a surface of the plug and a third surface of the second body portion.

13. The gas lift valve of claim 12 wherein the plug has a first end and a second end, wherein the first end of the plug is closer to the cap than the second end and wherein the crush washer is positioned at a location between the second end of the cap and the third surface of the second body portion.

14. A gas lift valve comprising:

a body defining an interior charging chamber;

a housing coupled to the body, the housing defining a first interior surface, a second interior surface, a first external surface, a second external surface, and a bore in fluid communication with the charging chamber;

a plug at least partially positioned within the bore;

a first resilient element forming a seal between an external surface of the plug and the first interior surface of the bore;

a crush washer positioned between the plug and the second interior surface of the housing; and a cap defining an interior bore, the cap being positioned with respect to the housing such that the plug is positioned within the cap interior bore;

a second resilient element forming a seal between the first external surface of the housing and a first interior surface of the cap; and a third resilient element forming a seal between the second external surface of the housing and a second interior surface of the cap.

15. The gas lift valve of claim 14 wherein the crush washer comprises copper.

16. The gas lift valve of claim 14 further comprising a valve assembly positioned within the bore, wherein the valve assembly includes a stem, wherein the crush washer defines a disc-shaped cavity, and wherein at least a portion of the stem is within the disc-shaped cavity.

17. The gas lift valve of claim 14 wherein both the cap and the housing comprise metal and a seal is created by metal to metal abutment of the cap and the housing.

18. The gas lift valve of claim 14 wherein, along a longitudinal axis of the valve, the crush washer is positioned between the first resilient element and the second resilient element.

19. The gas lift valve of claim 18 wherein, along the longitudinal axis, the first resilient element, is positioned between the third resilient element and the second resilient element.

* * * * *